US008361940B2

(12) United States Patent
Nakazato et al.

(10) Patent No.: US 8,361,940 B2
(45) Date of Patent: Jan. 29, 2013

(54) LOW SULFATED ASH, LOW SULFUR, LOW PHOSPHORUS, LOW ZINC LUBRICATING OIL COMPOSITION

(75) Inventors: Morikuni Nakazato, Shizuoka-ken (JP); Yoshitaka Takeuchi, Shizuoka-ken (JP); Takahiro Muramatsu, Shizuoka-ken (JP)

(73) Assignee: Chevron Japan Ltd., Tokyo (JP)

( * ) Notice: Subject to any disclaimer, the term of this patent is extended or adjusted under 35 U.S.C. 154(b) by 2 days.

(21) Appl. No.: 11/853,977

(22) Filed: Sep. 12, 2007

(65) Prior Publication Data

US 2008/0076686 A1 Mar. 27, 2008

(30) Foreign Application Priority Data

Sep. 26, 2006 (JP) ..... 2006-261282

(51) Int. Cl.
*C10M 141/00* (2006.01)
*C10M 141/12* (2006.01)

(52) U.S. Cl. ..... 508/291; 508/156; 508/362; 508/391; 508/460; 508/563; 508/586

(58) Field of Classification Search ..... 508/159, 508/199, 322, 273, 542, 518, 294, 186, 290, 508/539, 545, 583; 123/1 A
See application file for complete search history.

(56) References Cited

U.S. PATENT DOCUMENTS

| | | | | |
|---|---|---|---|---|
| 5,102,566 | A | 4/1992 | Fetterman, Jr. et al. | |
| 5,569,405 | A | 10/1996 | Nakazato et al. | |
| 5,629,272 | A | 5/1997 | Nakazato et al. | |
| 5,672,570 | A | 9/1997 | Miyaji et al. | |
| 5,726,133 | A | 3/1998 | Blahey et al. | |
| 6,147,035 | A | 11/2000 | Sougawa et al. | |
| 6,329,328 | B1 | 12/2001 | Koganei et al. | |
| 6,569,818 | B2 | 5/2003 | Nakazato et al. | |
| 2002/0019320 | A1 * | 2/2002 | Nakazato et al. | 508/159 |
| 2002/0098990 | A1 * | 7/2002 | Nakazato et al. | 508/322 |
| 2003/0148899 | A1 | 8/2003 | Kuribayashi et al. | |
| 2006/0025313 | A1 * | 2/2006 | Boffa | 508/199 |
| 2006/0089272 | A1 * | 4/2006 | Bardasz | 508/294 |
| 2007/0027045 | A1 * | 2/2007 | Kleijwegt | 508/518 |
| 2007/0049507 | A1 * | 3/2007 | Kleijwegt | 508/542 |
| 2007/0111904 | A1 * | 5/2007 | Van Dam | 508/273 |
| 2007/0111905 | A1 * | 5/2007 | van Dam | 508/273 |
| 2009/0064956 | A1 * | 3/2009 | Bardasz | 123/1 A |

FOREIGN PATENT DOCUMENTS

| | | | |
|---|---|---|---|
| EP | 0 562 172 | B1 | 3/1999 |
| EP | 1013749 | | 6/2000 |
| EP | 1 016 706 | | 1/2001 |
| EP | 1 167 497 | | 1/2002 |
| EP | 1167497 | | 1/2002 |
| EP | 1203804 | | 5/2002 |
| EP | 1 361 263 | | 11/2003 |
| EP | 1484534 | A1 * | 12/2004 |
| EP | 1 516 910 | | 3/2005 |
| JP | 09-111275 | | 4/1997 |
| JP | 90-111275 | | 4/1997 |
| JP | 2003/336089 | | 11/2003 |
| JP | 2003-336089 | | 11/2003 |
| WO | WO 96/06904 | | 3/1996 |
| WO | WO 96/37582 | | 11/1996 |
| WO | WO 2006/073198 | | 7/2006 |

OTHER PUBLICATIONS

International Search Report issued in counterpart European Patent Application No. 07253719.4.
International Search Report issued in counterpart Singapore Patent Application No. 200708901-4.

* cited by examiner

*Primary Examiner* — Ellen McAvoy
*Assistant Examiner* — Chantel Graham

(57) ABSTRACT

A low sulfated ash, tow sulfur, low phosphorus, low zinc lubricating, oil composition preferably employable for internal combustion engines using a low sulfur hydrocarbon fuel comprises a base oil having a saturated component of 85 wt. % or more, a viscosity index of 110 or more, and a sulfur content of 0.01 wt. % or less; an alkaline earth metal-containing detergent; a nitrogen-containing ashless dispersant of a weight average molecular weight of 4,500 or more; a phenolic or amine oxidation inhibitor; and a basic nitrogen-containing compound-oxymolybdenum complex.

15 Claims, No Drawings

LOW SULFATED ASH, LOW SULFUR, LOW PHOSPHORUS, LOW ZINC LUBRICATING OIL COMPOSITION

This application claims the benefit under 35 U.S.C. §119 to Japanese Application No. 2006-261282, filed Sep. 26, 2006.

FIELD OF INVENTION

The present invention relates to a low sulfated ash, low sulfur, low phosphorus lubricating oil composition favorably employable for lubricating internal combustion engines such as diesel engines, gasoline engines, gas engines and engines using dimethyl ether fuel. Particularly, the invention relates to a low sulfated ash, low sulfur, low phosphorus lubricating oil composition which gives low adverse effects to particulate filters and catalysts for cleaning exhausted gas and which therefore can cope with the exhausted gas regulations adopted in a near future. In more particular, the invention relates to a internal combustion engine lubricating oil composition which is favorably employable for automobiles using hydrocarbon fuel having a sulfur content of approximately 0.001 wt. % or less, particularly automobiles powered by a diesel engine equipped with an exhausted gas cleaning apparatus (particularly, a particulate filter of an exhausted gas cleaning catalyst).

BACKGROUND OF THE INVENTION

For internal combustion engines, particularly diesel engines; increased efforts have been undertaken to provide measures for reducing emissions caused by exhaust gas components such as particulates and $NO_x$. One method for addressing the above-mentioned issue is to equip the engine (such as an automobile—either by the original manufacturer or by aftermarket components) with an exhaust gas cleaning apparatus, such as a particulate filter or an exhausted gas cleaning catalyst (oxidative or reductive catalyst). However, if conventional lubricating oil compositions for internal combustion engines (which have a high sulfated ash content, a high phosphorus content and a high sulfur content) are used for these automobiles on which the exhaust gas cleaning apparatus is mounted, the soot produced by combustion of the lubricating oil in the engines would lead to deposits on the particular filter. Generally, the soot deposited oil the particulate filter is designed to be partially removed by oxidation or burning. However, there still is problem that residues produced by the burning the conventional oil soot, such as the metal oxide, the sulfated ash, and the carboxylate, may lead to plugging the filter.

Moreover, the high sulfur content contained in the fuel generates sulfuric acid or sulfates, which then migrate into the exhausted gas. The migration of the sulfuric acid or sulfate adversely effects to the catalyst cleaning effectiveness. In consideration of these problems, it is required to reduce the sulfur content in the fuel to a level as low as possible. Accordingly, it is anticipated that the reduction of sulfur content in fuel is accelerated in the near future. For example, the diesel fuel for automobiles on which a diesel engine is mounted now has a sulfur content so small as approximately 0.001 wt. %. In the case that the fuel contains a less amount of sulfur, the amount of a metal-containing detergent, which is incorporated into lubricating oil for neutralizing sulfuric acid, can be reduced. A lubricating oil works in engines for lubrication, but a portion of the lubricating oil is burned and exhausted. Therefore, it is considered that the amounts of phosphorus and metal in a lubricating oil preferably are as small as possible. Moreover, the reduction of the phosphorus content and sulfur content in the lubricating oil is preferred for reducing deterioration of the catalyst.

Japanese Provisional Patent Publication 2002-53888 (Patent Publication 1) describes a lubricating oil composition for internal combustion engines, which has a low ash content, a low phosphorus content, a low sulfur content, and a low chlorine content. The described lubricating oil composition gives less adverse influence to a particulate filter and an oxidation catalyst and shows good high temperature detergency, and therefore can satisfactorily cope with the anticipated exhausted gas regulations. The lubricating oil composition comprises a base oil (mineral oil and/or synthetic oil) having a sulfur content of 0.1 wt. % or less and the following additives dissolved or dispersed in the base oil in percent amounts based on the total amount of the oil composition:

(a) an ashless dispersant (alkenyl- or alkyl-succinimide or its derivative) in an amount of 0.01 to 0.3 wt. % in terms of the nitrogen content;
(b) a metal-containing detergent having a sulfur content of 3 wt. % or less and a TBN of 10-350 mg·KOH/g, in an amount of 0.1 to 1 wt. % in terms of a sulfated ash content;
(c) zinc dialkyldithiophosphate in an amount of 0.01 to 0.1 wt. % in terms of a phosphorus content; and
(d) an oxidation inhibiting phenol compound and/or an oxidation inhibiting amine compound in an amount of 0.01 to 5 wt. %.

The lubricating oil is further defined to have a sulfated ash content of 0.1 to 1 wt. %, a phosphorus content of 0.01 to 0.1 wt. %, a sulfur content of 0.01 to 0.3 wt. %, and a chlorine content of 40 ppm or less, and to contain an organic acid metal salt (which is contained in the detergent) in an amount of 0.2 to 7 wt. %.

Japanese Provisional Patent Publication 2003-336089 (Patent Publication 2) describes a lubricating oil composition comprising a base oil (mineral, oil and/or synthetic oil) having a lubricating viscosity and a sulfur content of 0.2 wt. % or less and the following additives dissolved or dispersed in the base oil in percent amounts based on the total amount of the oil composition:

(a) an ashless dispersant (alkenyl- or alkyl-succinimide or its derivative) in an amount of 0.01 to 0.3 wt. % in terms of the nitrogen content;
(b) a metal-containing detergent having a sulfur content of 3.5 wt. % or less and a TBN of 10-350 mg·KOH/g, in an amount of 0.1 to 1 wt. % in terms of a sulfated ash content;
(c) zinc dialkyldithiophosphate in an amount of 0.01 to 0.1 wt. % in terms of a phosphorus content;
(d) a phosphorus-containing ester selected from the group consisting of phosphoric acid esters, thiophosphoric acid esters, dithiophosphoric acid esters and phosphorous acid esters, in an amount of 0.002 to 0.05 wt. % in terms of a phosphorus content;
(e) an oxidation inhibitor selected from the group consisting of a phenol compound, an amine compound and a molybdenum compound, in an amount of 0.01 to 5 wt. %, wherein a ratio of the zinc dialkyldithiophosphate to the phosphorus-containing ester is 20/1 to 1/1 in terms of their phosphorus contents.

The lubricating oil is further defined to have a sulfated ash content of 0.1 to 1 wt. %, a phosphorus content of 0.01 to 0.1 wt. %, a sulfur content of 0.01 to 0.5 wt. %, and a chlorine content of 40 ppm or less, and to contain an organic acid metal salt (which is contained in the detergent) in an amount of 0.2 to 7 wt. %.

SUMMARY OF THE INVENTION

Formulating an internal combustion engine lubricating oil composition having a low sulfated ash content, a low phosphorus content, and a low sulfur content; requires reducing the content of the metal-containing detergent and zinc dialkyldithiophosphate that is heretofore used as a multi-functional additive. It is, however, well known to those skilled in the development of a lubricating oil composition that the reduction of the content of the metal-containing detergent and zinc dialkyldithiophosphate results in lowering of detergency at a high temperature and stability to oxidation of the lubricating oil. Moreover, the reduction of the content of zinc dialkyldithiophosphate results in lowering of wear resistance.

Both of the lubricating oils having a low sulfated ash content, a low sulfur content and a low phosphorus content which are described in Patent Publications 1 and 2 are formulated to optimize the combination of various known additive components, whereby the desired low sulfated ash content, low sulfur content and low phosphorus content are prepared. Both of the lubricating oils of Patent Publications 1 and 2, however, are formulated on the basis of concept that zinc dialkyldithiophosphate should be employed. Therefore, the desired low sulfated ash content, low sulfur content, and low phosphorus content cannot be reduced to exceed a certain level.

In addition, the present inventors have found that soot produced by burning a lubricating oil composition containing zinc dialkyldithiophosphate in internal combustion engines, particularly, diesel engines, is apt to aggregate or harden. The aggregated or hardened soot accelerates wear of the engine parts.

Accordingly, an aspect of the invention to provide a lubricating oil for internal combustion engines, more particularly diesel engines, which satisfactorily cope with the anticipated exhaust gas regulations.

In particular, the aspect is directed to provide a lubricating oil composition for internal combustion engines, more particularly, a diesel engine lubricating oil composition, which is characterized by a low sulfated ash content, a low sulfur content and a low phosphorus content, and which contains essentially no zinc dialkyldithiophosphate, whereby minimizing adverse influence to an exhaust gas cleaning apparatus such as a particulate filter or an exhausted gas clearing catalyst, but which shows good detergency at a high temperature aid good wear resistance, and which keeps wear caused by the produced soot at a low level.

The present inventors have discovered that a lubricating oil composition showing wear resistance and detergency at a high temperature and stability to oxidation equal to or higher than those shown the lubricating oil compositions employing zinc dialkyldithiophosphate which are disclosed in Patent Publications 1 and 2, can be prepared with employment of essentially no zinc dialkyldithiophosphate, by employing the following components.

(a) a mineral and/or synthetic base oil having a saturated component of 85 wt. % or more, a viscosity index of 110 or more, and a sulfur content of 0.01 wt. % or less;
(b) an alkaline earth metal containing detergent in an amount of 0.01 to 0.4 wt % in terms of alkaline earth metal content;
(c) nitrogen containing ashless dispersant having a weight average molecular weight of 4,500 or more;
(d) an oxidation inhibitor selected from the group consisting of a phenolic oxidation inhibitor or an amine oxidation inhibitor; and
(e) a basic nitrogen-containing compound-oxymolybdenum complex in an amount of 0.3 to 2.0 wt. %.

Accordingly, an aspect resides in a low sulfated ash, low sulfur, low phosphorus, low zinc, lubricating oil composition which has a sulfated ash content of 0.1 to 1.1 wt. %, a sulfur content of 0.01 to 0.3 wt. %, a phosphorus content of 0.08 wt. % or lower, and a zinc content of 0.07 wt. % or lower and which comprises the following base oil and additive components:

(a) a major amount of a mineral and/or synthetic base oil having a saturated component of 85 wt. % or more, a viscosity index of 110 or more, and a sulfur content of 0.01 wt. % or less;
(b) an alkaline earth metal-containing detergent in an amount of 0.01 to 0.4 wt. % in terms of an alkaline earth metal content;
(c) a nitrogen-containing ashless dispersant of a weight average molecular weight of 4,500 or more in an amount of 0.01 to 0.3 wt. % in terms of a nitrogen content;
(d) at least one oxidation inhibitor selected from the group consisting of a phenolic oxidation inhibitor or an amine oxidation inhibitor in an amount of 0.1 to 5 wt. %; and
(e) a basic nitrogen-containing compound-oxymolybdenum complex in an amount of 0.3 to 2.0 wt. %.

The contents of the additive components (b), (c), (d), and (e) are amounts per the low sulfated ash, a low sulfur, a low phosphorus, low zinc lubricating oil composition.

The lubricating oil composition of the invention shows good detergency at a high temperature and good resistance to wear, although it has a low sulfated ash content, a low phosphorus content, and a low sulfur content, and contains essentially no zinc dialkyldithiophosphate. Therefore, the lubricating oil composition of the invention is favorably employable for lubricating an engine which uses a hydrocarbon fuel having a sulfur content of approx. 0.001 wt. % or less, particularly an automobile diesel engine equipped with an exhausted gas cleaning apparatus (particularly, a particulate filter or an oxidative or reductive catalyst).

The lubricating oil composition is more particularly defined below. In one aspect the lubricating composition is characterized that the basic nitrogen compound-oxymolybdenum complex is a succinimide-oxymolybdenum complex.

In another aspect the lubricating composition is characterized that the phosphorus content is 0.01 wt. % or less (particularly 0.009 wt. % or less, more particularly 0.005 wt. % or less).

In another aspect the lubricating composition is characterized that the sulfur content is 0.3 wt. % or less (particularly 0.1 wt. % or less).

In another aspect the lubricating composition is characterized that the alkaline earth metal-containing detergent contains 30 wt. % or more of an alkaline earth metal-containing salicylate detergent having a total base number of 10 to 350 mg·KOH/g. More particularly, the alkaline earth metal-containing detergent further contains 30 wt. % or more of an alkaline earth metal-containing salicylate detergent having a total base number of 10 to 350 mg·KOH/g, 10 wt. % or more of an alkali earth metal-containing phenate detergent having a total base number of 10 to 350 mg·KOH/g and 10 wt. % or more of an alkali earth metal-containing sulfonate detergent having a total base number of 10 to 350 mg·KOH/g.

In another aspect the lubricating composition is characterized that the nitrogen containing ashless dispersant has a weight average molecular weight of 6,000 or more. A suitable nitrogen containing ashless dispersant is a bis-succinimide or polysuccinimide.

In another aspect the lubricating composition is characterized that the oxidation inhibitor selected from a phenolic oxidation inhibitor and an amine oxidation inhibitor is contained in an amount of 0.6 to 3 wt. %.

A preferred phenolic oxidation inhibitor is a hindered phenol compound and the amine oxidation inhibitor is a diarylamine compound.

In another aspect the lubricating composition is characterized that the basic nitrogen compound-oxymolybdenum complex is contained in an amount of 0.3 to 1.0 wt. % (particularly 0.3 to 0.8 wt. %). In this regard, the basic nitrogen-containing compound-oxymolybdenum complex preferably has a sulfur content of 0.05 to 0.5 wt. %.

The lubricating oil composition described in any of the aspects above may further contains an alkali metal boric acid hydrate and preferably in an amount of 0.1 to 2.0 wt. % and/or a viscosity index improver (particularly a dispersant viscosity index improver) and when employed preferably in an amount of 0.2 to 10 wt. %.

In another aspect the lubricating composition described in any of the aspects above may be characterized in that the lubricating oil composition contains no zinc dialkyldithiophosphate or contains zinc dialkyldithiophosphate in an amount of 0.01 wt. % or less in terms of a phosphorus content, more preferably in an amount of 0.005 wt. % or less in terms of a phosphorus content, and even more preferably consisting of essentially no phosphorous content. Accordingly one aspect is directed to phosphorous free lubricating compositions as described above.

One aspect of the lubricating composition is characterized that the alkali earth metal content/sulfur content are 1.7 or more.

In another aspect the lubricating composition is characterized that the ashless nitrogen-containing dispersant has a chlorine content of 40 wt. ppm or less (particularly 30 wt. ppm), and bis-succinimide or polysuccinimide or a derivative thereof which is obtained by the steps of reacting a highly reactive polybutene having at least 50% of a methylvinylidene structure and maleic anhydride under thermal reacting conditions to give a polybutenylsuccinic anhydride and reacting the polybutenylsuccinic anhydride with polyalkylenepolyamine. More particularly, the ashless nitrogen containing dispersant is a polysuccinimide or a derivative thereof, which is obtained by the steps of reacting a highly reactive polybutene, alpha-olefin, and maleic anhydride to give a terpolymer and reacting the terpolymer, aromatic amine, and polyether amine.

DETAILED DESCRIPTION OF THE INVENTION

The base oil and the additive components comprised in the lubricating oil compositions of the invention are further described below.

Base Oil

The base oil of the lubricating oil composition according to the invention is a mineral oil and/or a synthetic oil which has a saturated component of 85 wt. % or more (preferably 90 wt. % or more), a viscosity index, of 110 or more (preferably 120 or more, more preferably 130 or more), and a sulfur content of 0.01 wt. % or less (preferably 0.001 wt. % or less).

The mineral oil preferably is an oil, which is obtained by processing a lubricating oil distillate of a mineral oil by solvent refining, hydrogenation, or their combination. Particularly preferred is a highly hydrogenated refined oil (corresponding to a hydrocracked oil, typically has a viscosity index of 120 or more, an evaporation loss (ASTM D5800) of 15 wt. % or less, a sulfur content of 0.01 wt. % or less, and an aromatic component content of 10 wt. % or less). In addition, an mineral oil mixture containing the hydrocracked oil in an amount of 10 wt. % or more. The hydrocracked oil includes a high viscosity index oil (such as having a viscosity index of 140 or more, specifically 140 to 150) which is obtained by subjecting mineral oil-origin slack wax or synthetic wax prepared from natural gas to isomerization and hydrocracking and a gas-to-liquid base oil. The hydrocracked oil has a low sulfur content and a low residual carbon content and shows a low evaporation property, and therefore is preferred for the use in the lubricating oil composition of the invention.

Examples of the synthetic oils (synthetic lubricating base oils) include poly-α-olefin such as a polymerized compound of α-olefin having 3 to 12 carbon atoms; a dialkyl ester of a di-basic acid such as sebacic acid, azelaic acid, or adipic acid and an alcohol having 4 to 18 carbon atoms, typically dioctyl sebacate; a polyol ester which is an ester of 1,1,1-trimethylolpropane or pentaerythritol and a mono-basic acid having 3 to 18 carbon atoms; and alkylbenzene having an alkyl group of 9 to 40 carbon atoms. The synthetic oil generally contains essentially no sulfur, shows good stability to oxidation and good heat resistance, and gives less residual carbon and soot when it is burned. Therefore, the synthetic oil is preferably employed for the lubricating oil composition of the invention. Particularly preferred is poly-α-olefin, from the viewpoint of the object of the invention.

Each of the mineral oil and synthetic oil can be employed singly. If desired, two or more mineral oils can be employed in combination, and two or more synthetic oils can be employed in combination. The mineral oil and synthetic oil can be employed in combination at an optional ratio.

Alkaline Earth Metal-Containing Detergent

The lubricating oil composition of the invention contains an alkaline earth metal-containing detergent in an amount of 0.01 to 0.4 wt. % in terms of the alkaline earth metal content.

The alkaline earth metal-containing detergent preferably has a sulfur content of 3.5 wt. % or less and a TBN (total base number) of 10 to 350 mg·KOH/g.

Examples of the alkaline earth metal-containing detergents generally incorporated into lubricating oil compositions include sulfurized phenates, petroleum sulfonates, synthetic sulfonates, and salicylates.

The alkaline earth metal-containing detergent for the lubricating oil composition of the invention having a low ash content and a low sulfur content preferably has a low sulfur content and a moderate overbasing degree, contains a metal of a small atomic number (e.g., Mg, Ca, and Ba) and shows abase number higher than that expected for the contained metal, for providing the desired high detergency at a high temperature to the lubricating oil composition.

Therefore, a calcium-containing detergent, a barium-containing detergent and a magnesium-containing detergent are preferred. Most preferred is a calcium-containing detergent.

The alkaline earth metal-containing detergent employed for the lubricating oil composition of the invention preferably contains 30 wt. % or more (particularly 40 wt. % or more) of an alkaline earth metal-containing salicylate having a TBN (total base number) In the range of 10 to 350 mg·KOH/g. It is preferred that the lubricating oil composition further contains 10 wt. % or more of an alkaline earth metal-containing phenate having a TBN in the range of 10 to 350 mg·KOH/g, and 10 wt. % or more of an alkaline earth metal-containing sulfonate having a TBN in the range of 10 to 350 mg·KOH/g.

The alkaline earth metal-containing salicylate generally is an alkaline earth metal salt of alkylsalicylic acid which is prepared by the steps of reacting α-olefin having approx. 8 to 30 carbon atoms (mean value) and phenol to give an alkylphenol and subjecting the alkylphenol to Kolbe-Schmitt reaction. The alkaline earth metal salt can be prepared by converting a corresponding Na salt or K salt by double decomposition or sulfuric acid decomposition into a Ca salt or a Mg salt. The double decomposition using calcium chloride ($CaCl_2$) is not preferred because a residual chlorine is apt to migrate in the resulting salt. Otherwise, the alkylphenol is directly neutralized to give its Ca salt which is in turn subjected to carbonation, for yielding the calcium salicylate. This process is disadvantageous because its yield of conversion into the salicylate is lower than that of Kolbe-Schmitt reaction. Therefore, the alkaline earth metal-containing salicylate preferably is an non-sulfurized alkaline earth metal salicylate that is prepared by the combination of Kolbe-Schmitt reaction and the sulfuric acid decomposition and has a TBN in the range of 30 to 300 mg·KOH/g (more preferably 30 to 100 mg·KOH/g).

It is also preferred that the alkaline earth metal-containing detergent is an alkaline earth metal salt of an organic acid having a carbon-nitrogen bonding or an alkaline earth metal salt of a phenol derivative. Generally, reaction with an amine compound gives a compound having a high basicity derived from the basic nitrogen. This compound is preferred because it gives a high base number although it has a low ash content. For instance, a metal salt of an aminocarboxylic acid can be used. Preferred is an non-sulfurized alkyl phenate having a Mannich base structure (alkali metal salt or an alkaline earth metal salt). This compound is obtainable by the steps of reacting alkylphenol, formaldehyde, and amine or an amine compound according to the Mannich reaction to give a reaction product having an aminomethylated phenolic ring, and neutralizing the reaction product with a base such as calcium hydroxide to give the corresponding metal salt.

In addition to the alkaline earth metal-containing detergent, an alkaline earth metal sulfonate which is an alkaline earth metal salt of petroleum sulfonic acid, alkylbenzene sulfonic acid, or alkyloxybenzene sulfonic acid. From the viewpoint of imparting high detergency (at the same sulfated ash level) at a high temperature, an alkaline earth metal sulfonate that has a low over-basicity is advantageous. However, it is required mat the alkaline earth metal sulfonate having a low over-basicity is incorporated In a relatively large, amount. This results in increase of the sulfur content. It is also disadvantageous that the alkaline earth metal sulfonate having a low overbasicity hardly increases the total base number even if it is incorporated in a large amount. Therefore, it is preferred that the alkaline earth metal sulfonate having a low over-basicity is employed in combination with the aforementioned non-sulfurized alkaline earth metal salicylate or phenate derivative.

The conventionally employed sulfurized alkaline earth metal phenate is an alkaline earth metal salt (generally Ca salt or Mg salt) of a sulfurized alkyl phenol. The sulfurized alkaline earth metal phenate shows a high heat resistance, but has a sulfur content of approx. 3 wt. % or more, which is incorporated by the sulfurizing reaction. Therefore, the sulfurized alkaline earth metal phenate can be employed in combination with the aforementioned alkaline earth metal-containing detergent, preferably the non-sulfurized alkaline earth metal salicylate.

Nitrogen-Containing Ashless Dispersant

The nitrogen-containing ashless dispersant employed for the lubricating oil composition of the invention has a weight average molecular weight of 4,500 or more. The weight average molecular weight preferably is less than 50,000. The nitrogen-containing ashless dispersant having a weight average molecular weight of 4,500 or more preferably is a mixture of a nitrogen-containing ashless dispersant having a weight average molecular weight of 4,000 or more and a nitrogen-containing ashless dispersant having a weight average molecular weight of 6,000 or more at an appropriate ratio, and optionally further a nitrogen-containing ashless dispersant having a weight average molecular weight of 9,000 or more and a nitrogen-containing ashless dispersant having a weight average molecular weight of 4,000 or less. The weight average molecular weight used in the specification is a molecular weight determined by GPC analysis using polystyrene as a reference compound.

Examples of the nitrogen-containing dispersants include alkenyl- or alkylsuccinimide or a derivative thereof which is derived from polyolefin. The nitrogen-containing dispersant is incorporated into the lubricating oil composition in an amount of 0.01 to 0.3 weight percent in terms of a nitrogen content, based on the total amount of the lubricating oil composition. A representative succinimide is obtained by the reaction between succinic anhydride having a substituent of an alkenyl group or an alkyl group which has a high molecular weight and polyalkylenepolyamine containing 4 to 10 nitrogen atoms (preferably 5 to 7 nitrogen atoms) per one molecule. The alkenyl group or an alkyl group which has a high molecular weight is preferably derived from polyolefin, particularly polybutene, having a number average molecular weight in the range of approx. 900 to 5,000.

The process for obtaining the polybutenyl-succinic acid anhydride by the reaction of polybutene and maleic anhydride is generally performed by the chlorination process using a chloride compound. The chlorination process is advantageous in its reaction yield. However, the reaction product obtained by the chlorination process contains a large amount (for instance, approx. 2,000 ppm) of chlorine. If the thermal reaction process using no chloride compound is employed, the reaction product contains only an extremely small chlorine (for instance, 40 ppm or less). Moreover, if a highly reactive polybutene (containing a methylvinylidene structure at least approx. 50%) is employed in place of the conventional polybutene (mainly containing a α-olefin structure), even the thermal reaction process can give a high reaction yield. If the reaction yield is high, the reaction product necessarily contains a reduced amount of the unreacted polybutene. This means that a dispersant containing a large amount of the effective component (succinimide) is obtained. Accordingly, it is preferred that the polybutenyl succinic acid anhydride is produced from the highly reactive polybutene by the thermal reaction and that the produced polybutenyl succinic acid anhydride is reacted with polyalkylenepolyamine having an average nitrogen atom number in the range of 4 to 10 (in one molecule) to give the succinimide. The succinimide further can be reacted with boric acid, alcohol, aldehyde, ketone, alkylphenol, cyclic carbonate, organic acid or the like, to give a modified succinimide. Particularly, a borated alkenyl(or alkyl)-succinimide which is obtained by the reaction with boric acid or a boron compound is advantageous from the viewpoints of thermal and oxidation stability.

Other examples of the nitrogen-containing ashless dispersants include polymeric succinimide dispersants derived from ethylene-α-olefin copolymer (for instance, the molecular weight is 1,000 to 15,000), and alkenylbenzyl amine ashless dispersants.

The lubricating oil composition of the invention necessarily contains a nitrogen-containing ashless dispersant having a high molecular weight. If desired, the other ashless dispersants such as alkenylsuccinic acid ester dispersants can be employed in combination.

Oxidation Inhibitor

At least one oxidation inhibitor is selected from a phenolic type or an amine type oxidation inhibitor. A representative phenolic oxidation inhibitor is a hindered phenol compound, and a representative amine oxidation inhibitor is a diarylamine compound.

The hindered phenol compound and diarylamine compound are advantageous because both further provide high detergency at a high temperature. The diarylamine oxidation inhibitor is particularly advantageous because it has a base number derived from the contained nitrogen which serves to increase detergency at a high temperature. In contrast, the hindered phenol oxidation inhibitor is effective to reduce oxidative deterioration caused by $NO_x$.

Examples of the hindered phenol oxidation inhibitors include 2,6-di-t-butyl-p-cresol, 4,4'-methylenebis(2,6-di-t-butylphenol), 4,4'-methylenebis(6-t-butyl-o-cresol), 4,4'-isopropylidenebis(2,6-di-t-butylphenol), 4,4'-bis(2,6-di-t-butylphenol), 2,2'-methylenebis(4-methyl-t-butylphenol), 4,4'-thiobis(2-methyl-6-t-butylphenol), 2,2-thio-diethylenebis[3-(3,5-di-t-butyl-4-hydoxyphenol)propionate], octyl 3-(3,5-di-t-butyl-4-hydroxyphenyl)propionate, octadecyl 3-(3,5-di-t-butyl-4-hydroxyphenyl)propionate; and octyl 3-(5-t-butyl-4-hydroxy-3-methylphenyl)propionate.

Examples of the diarylamine oxidation inhibitors include alkyldiphenylamine having a mixture of alkyl groups of 4 to 9 carbon atoms, p,p'-dioctyldiphenylamine, phenyl-α-naphthylamine, phenyl-α-naphthylamine, alkylated α-naphthylamine, and alkylated phenyl-α-naphthylamine.

Each of the hindered phenol oxidation inhibitor and diarylamine oxidation inhibitor can be employed singly or in combination. If desired, other oil soluble oxidation inhibitors can be employed in combination with the hindered phenol oxidation inhibitor and/or the diarylamine oxidation inhibitor.

Basic Nitrogen-Containing Compound-Oxymolybdenum Complex

The lubricating oil composition of the invention further contains a basic nitrogen-containing compound-oxymolybdenum complex in an amount of 0.3 to 2.0 wt. %. The basic nitrogen-containing compound-oxymplybdenam complex having reduced coloring which is described in Japanese Patent Provisional Publication 2004-2866 is preferably employed. Preferred examples of the basic nitrogen-containing compound-oxymolybdenum complex include an oxymolybdenum complex of succinimide and an oxymolybdenum complex of carboxylamide.

The basic nitrogen-containing compound-oxymolybdenum complex can be prepared by the following process:

(a) an acidic molybdenum compound or its salt is caused to react with a basic nitrogen-containing compound such as succinimide, carboxylamide, hydrocarbyl monoamine, hydrocarbyl polyamine, Mannich base, phosphonamide, thio-phos-phonamide, phosphoramide and a dispersant-type viscosity index improver (or a mixture thereof) at a temperature of 120° C. or lower.

The basic nitrogen-containing compound-oxymolybdenum complex is described in detail in the above-mentioned Japanese Patent Provisional Publication 2004-2866.

In combination with the basic nitrogen-containing compound-oxymolybdenum complex, other molybdenum-containing compounds can be used. Examples of the molybdenum-containing compounds include sulfurized oxymolybdenum dithiocarbamate and sulfurized oxymolybdenum dithiophosphate.

Other Additives

The lubricating oil composition of the invention may further contain an alkali metal borate hydrate for increasing stability at a high temperature and a basic number. The alkali metal borate hydrate can be contained in an amount of 5 wt. % or less, particularly 0.01 to 5 wt. %. Some alkali metal borate hydrates contain an ash component and a sulfur component. Therefore, the alkali metal borate hydrate can be used in an appropriate amount in consideration of the composition of the resulting lubricating oil.

Examples of the alkali metal borate hydrates are described in U.S. Pat. Nos. 3,929,650 and 4,089,790. The alkali metal borate hydrate can be prepared by the steps of carbonizing a neutral alkali metal or alkaline earth metal sulfonate in the presence of an alkali metal hydroxide to give an overbased sulfonate and reacting the overbased sulfonate with boric acid to give a dispersion of an alkali metal borate particulate. The step of carbonation is preferably carried out in the presence of an ashless dispersant such as succinimide. Preferred alkali metals are sodium and potassium. Examples of the alkali metal borate hydrates include a dispersion of $KB_3O_5.H_2O$ particulate (particle size: 0.3 μm or less) dispersed in a medium containing neutral calcium sulfonate/succinimide. In consideration of resistance to water, the potassium can be replaced with sodium.

The lubricating oil composition of the invention preferably contains a viscosity index improver in an amount of 20 wt. % or less, preferably 1 to 20 wt. %. Examples of the viscosity index improvers are polymers such as polyalkyl methacrylate, ethylenepropylene copolymer, styrene-butadiene copolymer, and polyisobutylene. A dispersant viscosity index improver and a multi-functional viscosity index improver which are produced by providing dispersant properties to the above-mentioned polymer are preferably employed. The viscosity index improvers can be used singly or in combination.

The lubricating oil composition of the invention may further contain a small amount of various auxiliary additives. Examples of the auxiliary additives are described as follows:

(a) zinc dithiocarbamate or methylenebis(dibutyl dithiocarbamate) as an oxidation inhibitor or a wear inhibitor;
(b) an oil soluble copper compound;
(c) sulfur compounds (e.g., olefin sulfide, sulfurized ester, and polysulfide);
(d) organic amide compounds (e.g., oleylamide), phosphorus-containing esters (e.g., phosphoric acid ester, thiophosphoric acid ester, dithiophosphoric acid ester, and phosphorous acid ester);
(e) benzotriazol compounds and thiadiazol compounds functioning as metal deactivating agent;
(f) nonionic polyoxyalkylene surface active agents such as polyoxyethylenealkyl phenyl ether and copolymers of ethylene oxide and propylene oxide functioning as anti-rust agent and anti-emulsifying agent;
(g) a variety of amines, amides, amine salts, their derivatives, aliphatic esters of polyhydric alcohols, and their derivatives which function as friction modifiers;
(h) and various compounds functioning as anti-foaming agents and pour point depressants.

The auxiliary additives can be preferably incorporated into the lubricating oil composition in an amount of 3 wt % or less (particularly, 0.001 to 3 wt. %).

The lubricating oil composition of the invention can contain a small amount (0.07 wt. % or less, preferably 0.068 wt. % or less, in terms of the zinc content) of zinc dialkyldithiophosphate.

The lubricating oil composition of the invention is preferably formulated to give a multi-grade engine oil of a relatively low viscosity, such as 0W20, 0W30, 0W40, 5W20, 5W30, 5W40 or 10W20 (SAE viscosity grade), by incorporating a viscosity index, improver, from the viewpoint of fuel economy.

Example 1

Preparation of lubricating oil composition—A lubricating oil composition (engine oil) of the invention having an SAE viscosity grade of 5W30 was prepared using the following additives and base oil.

(A) Additives

Alkaline Earth Metal-Containing Detergent (1) sulfurized calcium phenate (Ca: 9.3 wt. %, S; 3.4 wt. %, TBN; 255 mg·KOH/g): 0.056 wt. % (in terms of Ca content)

(2) calcium salicylate (Ca: 6.3 wt. %, S: 0.1 wt. %, TBN: 177 mg·KOH/g): 0.056 wt. % (in terms of Ca content)

(3) calcium sulfonate (Ca: 2.4 wt. %, S; 2.9 wt. %, TBN; 17 mg·KOH/g): 0.020 wt. % (in terms of Ca content)

Nitrogen-Containuig Ashless Dispersant (1) Bis-succinimide dispersant-1 (weight average molecular weight: 12,800 (GPC analysis, value as molecular weight corresponding to polystyrene), nitrogen content: 1.0 wt. %, chlorine content; 30 wt. ppm., prepared by the steps of thermally reacting a highly reactive polyisobutene having a number average molecular weight of approx. 2,300 (containing at least approx. 50% of methylvinylidene structure) with maleic anhydride to give polyisobutenylsuccinic anhydride, reacting the polyisobutenylsuccinic anhydride with polyalkylenepolyamine having an average nitrogen atoms of 6.5 (per one molecule) to give a bis-succinimide, and reacting the bis-succinimide with ethylene carbonate): 0.060 wt. % (in terms of nitrogen content)

(2) Bis-succinimide dispersant-2 (weight average molecular weight: 5,100, nitrogen content: 1.95 wt. %, boron content: 0.66 wt. %, chlorine content: less than 5 wt. ppm., prepared by the steps of thermally reacting a highly reactive polyisobutene having a number average molecular weight of approx. 1,300 (containing at least approx. 50% of methylvinylidene structure) with maleic anhydride to give polyisobutenylsuccinic anhydride, reacting the polyisobutenylsuccinic anhydride with polyalkylenepolyamine having an average nitrogen atoms of 6.5 (per one molecule) to give a bis-succinimide, and reacting the bis-succinimide with boric acid); 0.031 wt. % (in terms of nitrogen content).

Oxidation Inhibitor (1) Amine oxidation inhibitor (dialkyldiphenylamine having a mixture of $C_4$ and $C_8$ alkyl groups, N: 4.6 wt. %, TBN: 180 mg·KOH/g): 0.5 wt. %

(2) Phenolic oxidation inhibitor (octyl 3-(3,5-di-t-bu-tyl-4-hydroxyphenyl)propionate): 0.5 wt. %

Basic Nitrogen-Containing Compound-Oxymolybdenum Complex

An oxymolybdenum complex of succinimide (containing sulfur, Mo: 5.5 wt. %, S: 0.2 wt. %, N: 1.6 wt. %, TBN: 10 mg·KOH/g, OLOA 17502 available from Chevron Japan Co., Ltd.: 0.4 wt. %.

Boron Compound

Dispersion of particulate of potassium borate hydrate ($KB_3O_5.H_2O$, K: 8.3 wt. %, B: 6.8 wt. %, S: 0.26 wt. %, TBN 125 mg·KOH/g, OLOA 9750 available from Chevron Japan Co., Ltd.): 0.4 wt. %.

Non-Dispersant Viscosity Index Improver

Non-dispersant ethylene-propylene copolymer viscosity index improver; 4.6 wt. %.

Pour Point Depressant

Polymethacrylate pour point depressant: 0.3 wt. %

(B) Base Oil (Residual Amount)

Mixture of 56 weight parts of hydrocracked mineral oil-1 (kinematic viscosity at 100° C.: 6.5 $mm^2/s$, viscosity index: 132, evaporation loss (ASTM D5800): 5.6 wt. %, sulfur content: less than 0.001 wt. %, saturated component content: 92 wt. %, aromatic component content: 8 wt. %) and 44 weight parts of hydrocracked mineral oil-2 (kinematic viscosity at 100° C.: 4.1 $mm^2/s$, viscosity index; 127, evaporation loss (ASTM D5800); 14 wt. %, sulfur content: less than 0.001 wt. %, saturated component content; 92 wt. %, aromatic component content; 8 wt. %).

Example 2

The procedures of Example 1 were repeated except that the boron compound was not used and the amount of the viscosity index improver was adjusted, to give a lubricating oil composition (engine oil, 5W30) according to the invention.

Example 3

The procedures of Example 1 were repeated except that the amine oxidation inhibitor was not used, the phenolic oxidation inhibitor was used in an amount of 1.0 wt. % and the amount of the viscosity index improver was adjusted, to give a lubricating oil composition (engine oil, 5W30) according to the invention.

Example 4

The procedures of Example 1 were repeated except that the phenolic oxidation inhibitor was not used, the amine oxidation inhibitor was used in an amount of 1.0 wt. % and the amount of the viscosity index improver was adjusted, to give a lubricating oil composition (engine oil, 5W30) according to the invention.

Example 5

The procedures of Example 1 were repeated except that the bis-succinimide dispersant-1 was used in an amount of 0.030 wt. % (in terms of N content), the below-described poly-succinimide dispersant was used in an amount of 0.019 wt. % (in terms of N content) and the amount of the viscosity index improver was adjusted, to give a lubricating oil composition (engine oil, 5W30) according to the invention.

Poly-succinimide dispersant (weight average molecular weight: 6,700, nitrogen content: 0.63 wt. %): prepared by the steps of reacting a highly reactive polyisobutene (number average molecular weight: approx. 2,300, containing at least approx. 50% of methylvinylidene structure), alpha-olefin, and maleic anhydride to give a terpolymer (succinimide) and reacting the terpolymer with aromatic amine and polyether amine.

Example 6

The procedures of Example 1 were repeated except that the below-described dispersant viscosity index improver was added in an amount of 0.002 wt. % (in terms of N content) and the amount of the viscosity index improver was adjusted, to give a lubricating oil composition (engine oil, 5W30) according to the invention.

Dispersant viscosity index improver (nitrogen-containing olefin copolymer, nitrogen content: 0.093 wt. %, weight average molecular weight: 147,000, HITEC 5777, available from Afton Chemical Corporation).

Example 7

The procedures of Example 1 were repeated except that the base oil comprised 70 wt. % of the mixture of hydrocracked mineral oils and 30 wt. % of a synthetic oil (poly-alfa-olefin (PAO) having decene-1 oligomer, kinematic viscosity; 5.9 $mm^2/s$, viscosity index; 140) and the amount of the viscosity index improver was adjusted, to give a lubricating oil composition (engine oil, 5W30) according to the invention.

REFERENCE EXAMPLES

A low sulfated ash, low sulfur, low phosphorus lubricating oil composition (engine oil, 5W30) containing a small amount of zinc dialkyldithiophosphate was prepared referring to the aforementioned Patent Publication 2.

The difference of the additive compositions from those of Example 1 was as follows;

(1) the amine oxidation inhibitor was used in an amount of 0.3 wt. %;

(2) the phenolic oxidation inhibitor was used in an amount of 0.2 wt. %;

(3) the oxymolybdenum complex of succinimide was used in an amount of 0.2 wt. %, and sulfurized oxymolybdenum thiocarbamate (MoDTC, Mo: 6.8 wt. %, S: 4.7 wt. %) in an amount of 0.2 wt. % was added;

(4) the following zinc dialkyldithiophosphate mixture was used;

ZnDTP-1 (0.050 wt. % in terms of P content): zinc dialkyldithiophosphate (P: 7.2 wt. %, Zn: 7.8 wt. %, S: 14 wt. %, derived from secondary alcohol having 3-8 carbon atoms)

ZnDTP-2 (0.024 wt. % in terms of P content): zinc dialkyldithiophosphate (P; 7.3 wt. %, Zn: 8.4 wt. %, S: 14 wt. %, derived from primary alcohol having 8 carbon atoms);

(5) a phosphorous acid ester (tricresyl phosphite, P content: 8.8 wt. %) was used in an amount of 0.023 wt. % (in terms of P content).

COMPARISON EXAMPLE 1

The procedures of Reference Example were repeated using no zinc dialkyldithiophosphate and no phosphorous ester and the amount of the viscosity index improver was adjusted, to give a lubricating oil composition (engine oil, 5W30) for comparison.

COMPARISON EXAMPLE 2

The procedures of Example 1 were repeated using no basic nitrogen containing compound-oxymolybdenum complex and no boron compound and the amount of the viscosity index improver was adjusted, to give a lubricating oil composition (engine oil, 5W30) for comparison.

COMPARISON EXAMPLE 3

The procedures of Example 1 were repeated using a low molecular weight nitrogen-containing ashless dispersant (bis-succinimide having a weight average molecular weight of approx, 4,000 derived from polyisobutene having a number average molecular weight of approx. 900, amount (in terms of N amount): 0.092 wt. %) as the nitrogen-containing ashless dispersant and the amount of the viscosity index improver was adjusted, to give a lubricating oil composition (engine oil, 5W30) for comparison.

COMPARISON EXAMPLE 4

The procedures of Example 1 were repeated using the non-dispersant viscosity index improver man amount of 7 wt. % and the below-mentioned mixture of solvent refined mineral oils and the amount of the viscosity index improver was adjusted, to give a lubricating oil composition (engine oil, 5W30) for comparison:

(a) mixture of solvent refined mineral oils: a mixture comprising 52 wt. % of a solvent refined mineral oil 80 NL (kinematic viscosity at 100° C.: 3.3 $mm^2/s$, viscosity index:

(b) 100, evaporation loss: 37 wt. %, sulfur content: 0.13 wt. %, saturated component content: 77 wt. %, aromatic component content: 23 wt. %) and 48 wt. % of a solvent refined mineral oil 150 NL (kinematic viscosity at 100° C.: 4.8 $mm^2/s$, viscosity index:

(c) 102, evaporation loss: 14 wt. %, sulfur content: 0.23 wt. %, saturated component content: 71 wt. %, aromatic component content; 29 wt. %).

Chemical Analysis of Luibricating Oil Composition

The analytical data of the lubricating oil compositions of Examples 1 to 7, Reference Example, and Comparison Examples 1 to 4 are set forth in Table 1.

TABLE 1

| | Sulfated ash (wt. %) | N (wt. %) | Ca (wt. %) | P (wt. %) | S (wt. %) | Ca/S |
|---|---|---|---|---|---|---|
| Ex. 1 | 0.56 | 0.12 | 0.13 | 0.00 | 0.07 | 1.9 |
| Ex. 2 | 0.50 | 0.12 | 0.13 | 0.00 | 0.07 | 1.9 |
| Ex. 3 | 0.50 | 0.10 | 0.13 | 0.00 | 0.07 | 1.9 |
| Ex. 4 | 0.50 | 0.14 | 0.13 | 0.00 | 0.07 | 1.9 |
| Ex. 5 | 0.56 | 0.11 | 0.13 | 0.00 | 0.07 | 1.9 |
| Ex. 6 | 0.56 | 0.12 | 0.13 | 0.00 | 0.07 | 1.9 |
| Ex. 7 | 0.56 | 0.12 | 0.13 | 0.00 | 0.07 | 1.9 |
| Ref. Ex. | 0.65 | 0.11 | 0.13 | 0.10 | 0.23 | 0.6 |
| Com. 1 | 0.50 | 0.11 | 0.13 | 0.00 | 0.08 | 1.6 |
| Com. 2 | 0.48 | 0.11 | 0.13 | 0.00 | 0.07 | 1.9 |
| Com. 3 | 0.54 | 0.12 | 0.13 | 0.00 | 0.07 | 1.9 |
| Com. 4 | 0.56 | 0.12 | 0.13 | 0.00 | 0.23 | 1.6 |

Remarks: The zinc (Zn) content was 0 wt. % for Examples 1-7 and Comparison Examples 1-4, and 0.08 wt. % for Reference Example.

Evaluation of Lubricating Oil Composition (1) Wear Inhibition

In order to simulate soot wear in a diesel engine, 1.5 wt. % of carbon black (mean particle diameter: 22 nm, specific surface area: 134 $m^2/g$) was blended in the lubricating oil composition by means of a high speed agitator to give a test oil. The test oil containing carbon black was then subjected to the following wear test:

the test oil was placed in a Shell four-ball tester, and the tester was run under the conditions that the rotation rate was 1,500 rpm, the period was 60 minutes, the load was 30 kg, and the test oil was heated to 110° C. After the run was complete, the fixed ball of the tester was subjected to measurement of an average diameter of the wear area.

(2) Detergency at High Temperature

The lubricating oil composition was subjected to the below-mentioned hot tube test (KES-07-803) to evaluate detergency at a high temperature:

a glass tube (inner size: 2 mm) was vertically set in the heater block, and the lubricating oil composition and air were supplied into the lower part of the glass tube at a rate of 0.31 cc/hr., and 10 cc/min., respectively. This procedure was continued for 16 hours, keeping the temperature of the heater part at 280° C. After the test procedure was complete, the deposit on the inner wall of the glass tube was observed and marked the conditions of the deposit on the basis of 10 points.

The results of the evaluation of the wear inhibition (evaluated by determining the mean diameter of the wear area, a smaller mean diameter means that the wear inhibition is higher) and the detergency at a high temperature (expressed by the marked point, point 10 means that no deposit is observed, and a lower marked point means production of large deposit) are set forth in Table 2.

TABLE 2

| | Wear Inhibition (Wear size: mm) | High temperature detergency (point) |
|---|---|---|
| Example 1 | 0.515 | 9.5 |
| Example 2 | 0.525 | 9.5 |
| Example 3 | 0.520 | 9.0 |
| Example 4 | 0.525 | 9.5 |
| Example 5 | 0.465 | 9.5 |
| Example 6 | 0.490 | 9.5 |
| Example 7 | 0.498 | 9.5 |
| Ref. Example | 0.565 | 7.5 |
| Com. Ex. 1 | 0.595 | 9.0 |
| Com. Ex. 2 | 0.615 | — |
| Com. Ex. 3 | 0.550 | — |
| Com. Ex. 4 | 0.565 | — |

The analytical data set forth in Table 1 and the evaluation data set forth in Table 2 indicate that the lubricating oil composition of the invention containing no zinc dialkyldithiophosphate (ZnDTP) and having a low sulfated ash content, a low sulfur content and a low phosphorus content show superior wear inhibition performance and high temperature detergency to the known lubricating oil (Reference Example) containing zinc dialkyldithiophosphate (ZnDTP) and having a low sulfated ash content, a low sulfur content a low phosphorus content. Further, it is understood that the lubricating oil composition of the invention shows an anti-wear performance prominently superior to the lubricating oil composition (Comparison Example 1) which is the same as the lubricating oil composition of Reference Example except for containing no ZnDTP and no phosphorous ester. Furthermore, it is understood that all of lubricating oil compositions not containing at least one compound which is prerequisite for the lubricating oil composition, that is, the lubricating oil composition of Comparison Example 2 containing increased amounts of the amine oxidation inhibitor and phenolic oxidation inhibitor but containing no basic nitrogen-containing compound-oxymolybdenum complex, the lubricating oil composition of Comparison Example 3 containing a nitrogen-containing ashless dispersant having a low molecular weight in place of the nitrogen-containing ashless dispersant having a high molecular weight, and the lubricating oil composition of Comparison Example 4 using a mixture of solvent refined mineral oils which does not satisfy the requirement of the invention, show results apparently inferior to those shown by the lubricating oil composition of the invention.

(3) Diesel Engine Test (JASO M354-99)

The lubricating oil composition of Example 1 was evaluated in its wear inhibition performance by the following diesel engine test:

diesel engine: water-cooled, 4-cylinders, displacement 3.9 litter, fuel direct injection, equipped with turbo-intercooler:

fuel: diesel fuel having a sulfur content in an amount of 0.001 wt. %; test conditions: 105° C. (oil temperature), 3,200 rpm (engine rotation), 160 hours (full load operation)

evaluation; wear evaluation was performed on the cam wear according to the Japan Petroleum Institute (JPI) method after the test operation was complete.

The results of evaluation indicated that the average cam wear was 46 μm which passed the JASO DH-2 requirement defining that satisfactory average cam wear should be 95 μm or lower).

What is claimed is:

1. A low sulfated ash, low sulfur, low phosphorus, low zinc, diesel engine lubricating oil composition which has a sulfated ash content of 0.1 to 1.1 wt. %, a sulfur content of 0.01 to 0.3 wt. %, a phosphorus content of 0.08 wt. % or lower, and a zinc content of 0.07 wt. % or lower, said diesel engine lubricating oil composition comprising: (a) a major amount of a mineral or synthetic base oil having a saturated component of 85 wt. % or more, a viscosity index of 110 or more, and a sulfur content of 0.01 wt. % or less; (b) an alkaline earth metal-containing detergent in an amount of 0.01 to 0.4 wt. % in terms of an alkaline earth metal content; (c) a nitrogen-containing ashless dispersant of a weight average molecular weight of 4,500 or more in an amount of 0.01 to 0.3 wt. % in terms of a nitrogen content; (d) at least one oxidation inhibitor in an amount of 0.1 to 5 wt. %, selected from the group consisting of a phenolic oxidation inhibitor and an amine oxidation inhibitor; and (e) a basic nitrogen-containing compound-oxymolybdenum complex in an amount of 0.3 to 2.0 wt. %, and wherein the diesel engine lubricating oil composition contains no zinc dialkyldithiophosphate.

2. The lubricating oil composition of claim 1, in which the basic nitrogen-containing compound-oxymolybdenum complex is a succinimide-oxymolybdenum complex.

3. The lubricating oil composition of claim 1, in which the phosphorus content is 0.01 wt. % or less.

4. The lubricating oil composition of claim 1, in which the alkaline earth metal-containing detergent contains 30 wt. % or more of an alkaline earth metal-containing salicylate detergent having a total base number of 10 to 350 mg·KOH/g.

5. The lubricating oil composition of claim 4, in which the alkaline earth metal-containing detergent further contains 10 wt. % or more of an alkaline earth metal-containing phenate detergent having a total base number of 10 to 350 mg·KOH/g and 10 wt. % or more of an alkaline earth metal-containing sulfonate detergent having a total base number of 10 to 350 mg·KOH/g.

6. The lubricating oil composition of claim 1, in which the nitrogen-containing ashless dispersant has a weight average molecular weight of 6,000 or more.

7. The lubricating oil composition of claim 1, in which the nitrogen-containing ashless dispersant is a bis-succinimide or poly-succinimide.

8. The lubricating oil composition of claim 1, in which the oxidation inhibitor selected from a phenolic oxidation inhibitor and an amine oxidation inhibitor is contained in an amount of 0.6 to 3 wt. %.

9. The lubricating oil composition of claim 1, in which the phenolic oxidation inhibitor is a hindered phenol compound and the amine oxidation inhibitor is a diarylamine compound.

10. The lubricating oil composition of claim 1, in which the basic nitrogen-containing compound-oxymolybdenum complex is contained in an amount of 0.3 to 1.0 wt. %.

11. The lubricating oil composition of claim 1, in which the basic nitrogen-containing compound-oxymolybdenum complex has a sulfur content of 0.05 to 0.5 wt. %.

12. The lubricating oil composition of claim 1, which contains an alkali metal borate hydrate in an amount of 0.1 to 2.0 wt. %.

13. The lubricating oil composition of claim 1, which contains a dispersant viscosity index improver in an amount of 0.2 to 10 wt. %.

14. The lubricating oil composition of claim 1, in which a ratio of an alkaline earth metal content/sulfur content is 1.7 or more.

15. A method for improving wear in a diesel engine comprising operating a diesel engine equipped with an exhaust gas cleaning apparatus using a diesel hydrocarbon fuel having a sulfur content less than 0.001 wt % and lubricating said engine with a diesel engine lubricating oil composition characterized by a low sulfated ash, low sulfur, low phosphorus, and low zinc content, wherein the diesel engine lubricating oil composition has a sulfated ash content of 0.1 to 1.1 wt. %, a sulfur content of 0.01 to 0.3 wt. %, a phosphorus content of 0.08 wt. % or lower, and a zinc content of 0.07 wt. % or lower, and said diesel engine lubricating oil composition comprising: (a) a major amount of a mineral or synthetic base oil having a saturated component of 85 wt. % or more, a viscosity index of 110 or more, and a sulfur content of 0.01 wt. % or less; (b) an alkaline earth metal-containing detergent in an amount of 0.01 to 0.4 wt. % in terms of an alkaline earth metal content; (c) a nitrogen-containing ashless dispersant of a weight average molecular weight of 4,500 or more in an amount of 0.01 to 0.3 wt. % in terms of a nitrogen content; (d) at least one oxidation inhibitor in an amount of 0.1 to 5 wt. %, selected from the group consisting of a phenolic oxidation inhibitor and an amine oxidation inhibitor; and (e) a basic nitrogen-containing compound-oxymolybdenum complex in an amount of 0.3 to 2.0 wt. %, and further wherein the diesel engine lubricating oil composition-contains no zinc dialkyldithiophosphate.

* * * * *